United States Patent [19]

Romanauskas

[11] 4,435,169

[45] Mar. 6, 1984

[54] CENTRIFUGE ROTOR HAVING A CLOSABLE WINDSHIELD

[75] Inventor: William A. Romanauskas, Southbury, Conn.

[73] Assignee: E. I. Du Pont de Nemours and Company, Wilmington, Del.

[21] Appl. No.: 427,907

[22] Filed: Sep. 29, 1982

[51] Int. Cl.[3] ..... B04B 5/02

[52] U.S. Cl. ..... 494/20; 494/60

[58] Field of Search ..... 494/20, 16, 60, 4, 12

[56] References Cited

U.S. PATENT DOCUMENTS

| | | | |
|---|---|---|---|
| 650,529 | 5/1900 | Eggeman | 494/16 |
| 724,801 | 10/1903 | Penn | 494/20 |
| 1,815,409 | 7/1931 | Knuttel | 494/4 |
| 2,005,094 | 6/1935 | Lindgren | 233/46 |
| 3,028,075 | 4/1962 | Blum | 494/20 |
| 4,010,890 | 3/1977 | Wright | 233/1 R |
| 4,046,317 | 9/1977 | Hein, Jr. | 233/23 R |
| 4,090,661 | 5/1978 | Lovegrove | 233/1 R |

*Primary Examiner*—Robert W. Jenkins

[57] ABSTRACT

A swinging bucket centrifuge rotor includes a windshield having upper and lower portions in which the lower portion of the windshield is movable with respect to the shaft from an open to a closed position in response to a closing force generated by rotation of the rotor.

14 Claims, 10 Drawing Figures

CENTRIFUGE ROTOR HAVING A CLOSABLE WINDSHIELD

BACKGROUND OF THE INVENTION

This invention relates to a centrifuge rotor, and in particular, to a swinging bucket centrifuge rotor having a windshield a portion which is movable with respect to the rotor shaft from a rest to a closed position.

In the design of nonevacuated centrifuge rotors tradeoffs are made between the volume of material able to be carried by the rotor and the relative centrifugal force able to be generated by rotation of the rotor. In centrifuge rotors of the swinging bucket type the volume of material able to carried by the rotor is functionally related to the number of swinging buckets able to be disposed on and carried by the rotor as well as the volume of each of the buckets.

The relative centrifugal force developed by a rotor is windage limited. That is, for a given rotor volume the maximum operating speed at which that rotor may rotate is usually limited by the drive torque available to the rotor at that speed. Thus increasing rotor volume, as by increasing the number or size of the buckets, may have an adverse effect upon the amount of relative centrifugal force able to be generated by the rotor.

In the case of a swinging bucket rotor losses are engendered by the pumping action of the rotor's arms as the rotor is rotated. The pumping losses are minimized by providing a windshield which completely encloses the rotor. Conventional windshields include a lower portion which is fixed to the rotor shaft and an upper cover which is removable from the shaft. With the cover removed material to be centrifuged is introduced into the buckets and the cover replaced. Driving torque is then applied to the rotor causing the buckets to swing from their rest position (in which the axis of each bucket lies parallel to the rotor's axis of rotation) to their operating position (in which the axis of each bucket extends substantially perpendicularly to the axis of rotation). It should be noted that in the conventional windshielded rotor the windshield encloses the buckets while they occupy all altitudes from the rest to the operating position.

Although windshielding a swinging bucket rotors minimizes pumping losses and thereby contributes to increased relative centrifugal force it is not possible to merely increase the volume of the buckets within the windshielded rotor and thereby increase rotor volume while maintaining the same relative centrifugal force. This is because the configuration of the windshield itself imposes windage losses on the system which are increased as the windshield increases in size.

Accordingly, it is believed desirable to provide a swinging bucket centrifuge rotor wherein the relative centrifugal force available for a given rotor volume is increased.

SUMMARY OF THE INVENTION

The present invention deals with a centrifuge apparatus wherein the windage generated by a swinging bucket rotor of a given volume may be decreased thereby increasing the relative centrifugal force able to be generated by a rotor at that volume.

The rotor comprises a shaft having a plurality of buckets pivotally mounted thereto, the buckets being movable from a rest position in which the axis of each bucket lies parallel to the axis of rotation to an operating position in which the axis of each of the buckets extends in a plane substantially perpendicular to the rotor's axis of rotation. An upper windshield portion is attached to the shaft, the outer boundary of the upper windshield portion terminating in a mating edge. A lower windshield portion also having a mating edge thereon is movably mounted with respect to the shaft in a direction parallel to the axis of rotation. The lower windshield portion is movable with respect to the shaft from an open position in which the lower windshield portion lies on the shaft at a position below the buckets as they occupy their rest position to a closed position in which the mating edges on the lower and upper windshield portions are engaged. The lower windshield portion moves with respect to the shaft to the closed position in response to a closing force generated as a result of the rotation of the rotor. In the preferred embodiment the closing force is the result of the pressure differential generated by the centrifugal pumping action of the rotor and buckets.

BRIEF DESCRIPTION OF THE DRAWINGS

The invention will be more fully understood from the following detailed description thereof taken in connection with the accompanying drawings which form a part of the application and in which.

DETAILED DESCRIPTION OF THE INVENTION

Figure 1:
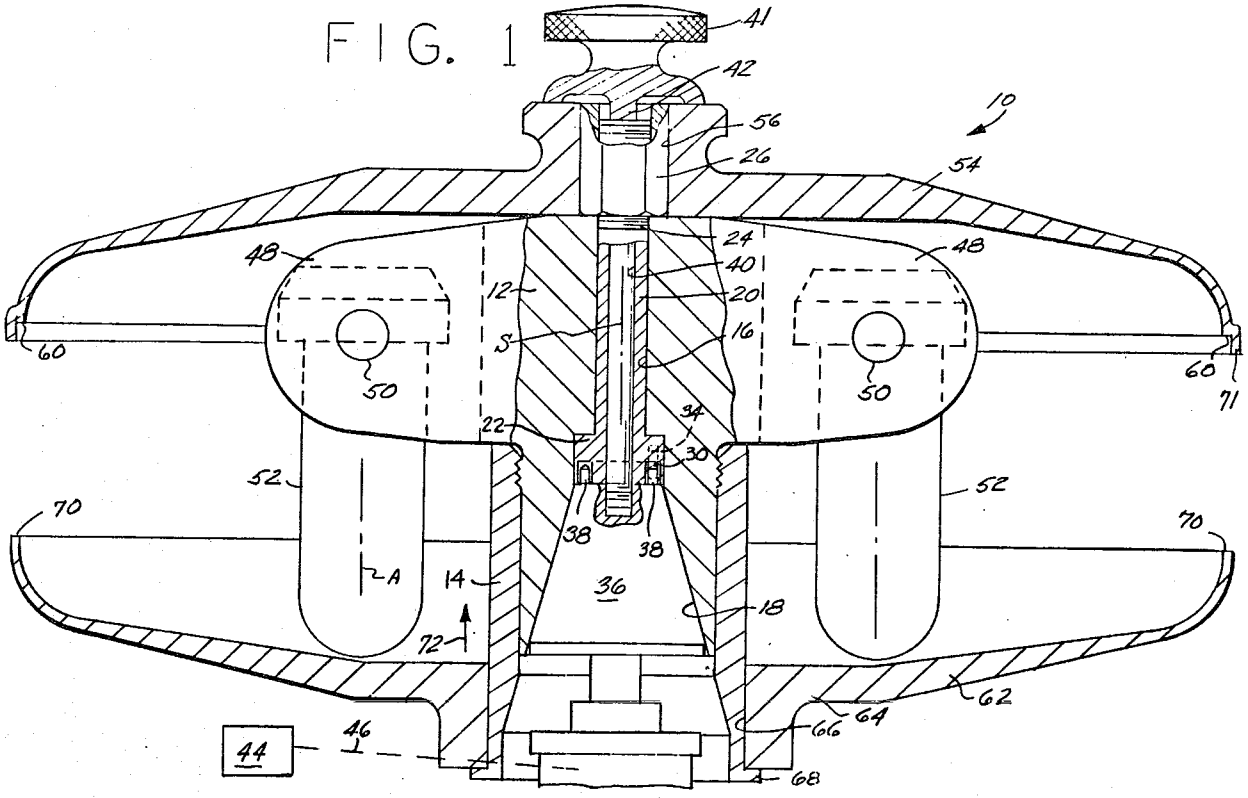
FIGS. 1 and 2 are side elevation views entirely in section showing a rotor having a windshield in accordance with the present invention with the windshield in the open and closed positions, respectively.

Throughout the following detailed description similar reference numerals refer to similar elements in all Figures of the drawings.

Figure 3:
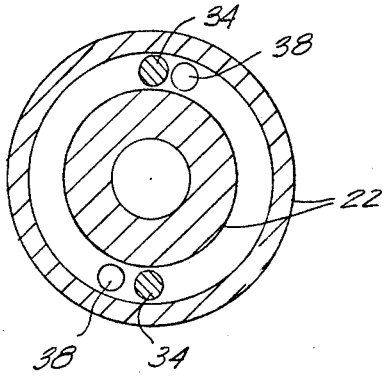
FIG. 3 is a section view taken along section lines III—III in FIGS. 1 and 2.

With reference to the Figures a centrifuge rotor of the swinging bucket type generally indicated by reference numeral 10 includes a shaft with a central hub 12 having a lower skirt portion 14 thereon. A central axial bore 16 having a truncated conical portion 18 extends through the interior of the rotor 10. A drive adapter 20 having an enlargement 22 thereon extends through the bore 16. The upper end of the drive adapter 20 is provided with threads 24 which receive a cover drive nut 26. The enlargement 22 of the adapter 20 is provided with an annular groove 30 in which drive posts 34 (only one of which is visible in FIG. 1) are disposed (see also FIG. 3).

A rotor gyro 36 having drive pins 38 thereon extends into the conical portion 18 of the bore with the pins 38 extending into the groove 30. The adapter 20 is itself provided with a central axial bore 40. A knob 41 having an elongated threaded rod 42 connected thereto extends through the bore 40 to secure the rotor 10 to the gyro 36. In addition, the knob 41 clamps a cover 54 to the hub portion 12 of the rotor 10 to prevent relative motion between the center of gravity of the rotor 10 and the cover 54. The gyro 36 is operatively connected to a drive motor 44 as shown by the schematic linkage 46. Rotation of the gyro 36 brings the pins 36 thereon into driving engagement with the pins 34 (believed best seen in FIG. 3) to thereby rotate the rotor 10.

The rotor 10 includes a plurality of arms 48 extending radially outwardly from the central hub 12 of the shaft. A plurality of swinging buckets 52 is pivotally mounted by any suitable means of attachment (such as trunnion pins 50) between pairs of adjacent ones of the arms 48. The buckets 52 are pivotable from a rest position (FIG. 1) in which the axis A of each of the buckets 52 is substantially parallel to the rotor's axis of rotation S to an operating position in which the axes A of the buckets 52 lie generally perpendicular to the axis S. Of course, it should be appreciated that while in the rest position the axis of each bucket may assume any predetermined orientation with respect to the axis S.

Figure 2:
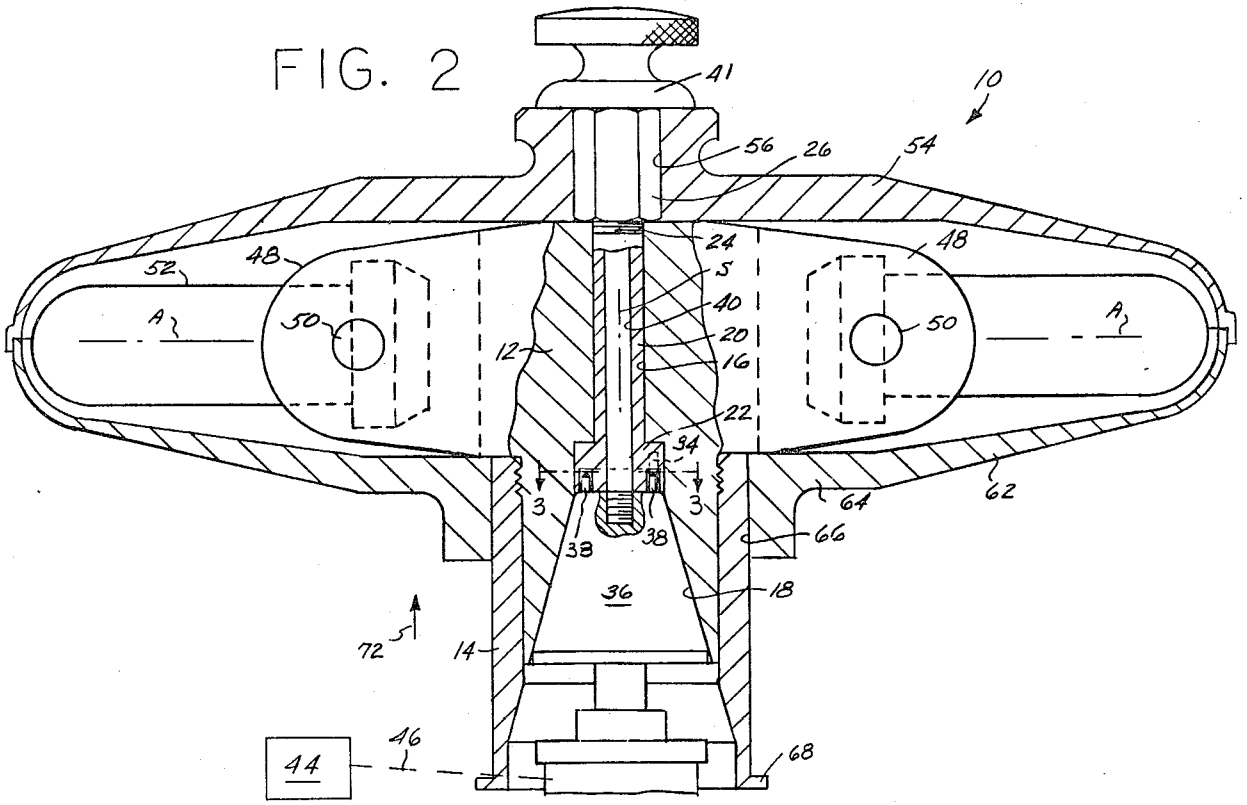
Figure 4:
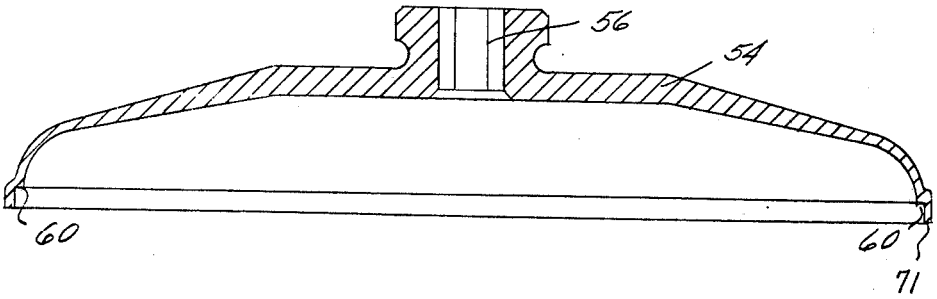
FIGS. 4 and 5 are, respectively, side section views of an upper windshield portion a lower windshield portion in accordance with the present invention.

An upper windshield portion 54 (FIGS. 1 and 4) is removably mounted to the drive cover nut 26. The upper windshield portion 54 is provided with a hexagonal opening 56 (FIG. 4) which is received on the drive nut 26 so as to prevent rotation of upper windshield 54 with respect to the hub 12. The outer peripheral edge of the upper windshield portion 54 terminates in a mating surface 60. A lower windshield portion 62 (FIGS. 1 and 5) has a central region 64 through which an opening 66 extends. The lower windshield portion 62 is movably mounted on the skirt portion 14 of the shaft between an open position (FIG. 1) defined by a lower stop 68 mounted to the shaft and a closed position (FIG. 2). The outer periphery of the lower windshield portion 62 terminates in a mating surface 70. The upper windshield portion 54 is provided with a circumferential annular band 71 the inside diameter of which is greater than the outside diameter of the lower windshield portion 62. The upper windshield portion 54 is stiffer than the lower windshield portion 62.

Figure 5:
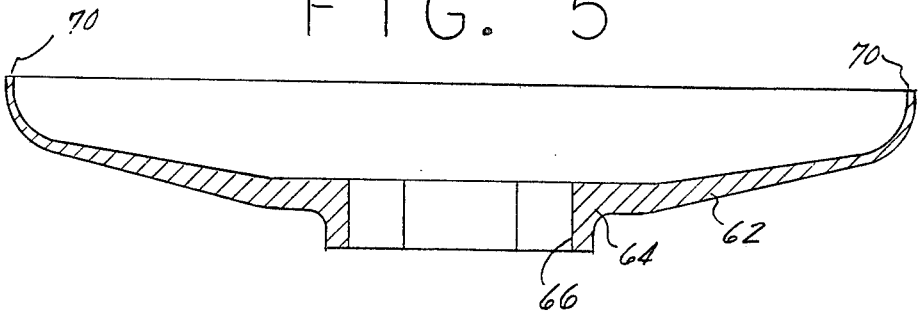

As is explained herein the lower windshield portion 62 is movable along the skirt 14 in a direction parallel to the axis S between the open and closed positions. In the preferred embodiment the lower windshield portion 62 is nonrotatably mounted with respect to the skirt 14. To effect this end the skirt 14 is substantially hexagonal in cross section. The opening 66 in the lower windshield portion 62 is correspondingly shaped (FIG. 5). The lower windshield portion 62 is thus slidably but nonrotatably mounted to the skirt 14. Of course the upper and lower windshield portions may be made nonrotatably mounted to the shaft by any suitable expedient.

The windshield portions 54 and 62 are fabricated of any suitable material, preferably a high strength aluminum alloy. The skirt 14 and boundary surface of the opening 66 in the lower windshield 62 are provided with smooth, highly polished finishes to expedite the sliding movement of the lower windshield with respect thereto. If the windshield portion 62 is fabricated of aluminum, the surface of the skirt 14 and the boundary of the opening 66 are provided with an anodized aluminum hardcoat. Alternatively, any suitable solid film lubrication may be utilized whatever construction materials are used to fabricate the rotor and windshield portions.

In operation, with the upper windshield portion 54 removed from the rotor and the lower windshield portion 62 in the open position (FIG. 1) material to be centrifuged is introduced into the buckets. In the rest position the buckets 52 depend downwardly from the rotor arms 48 such that the axes A of the buckets 52 are substantially parallel to the axis S of the rotor shaft. When the buckets 52 have been charged to the desired extent the buckets may be capped (if desired) and the upper windshield portion 54 is secured to the rotor shaft and motive energy is applied to the rotor.

The buckets 52 respond to the motive energy applied to the rotor by pivoting from the rest position (FIG. 1) to the operating position (FIG. 2) in which the axes A of the buckets 52 extend substantially perpendicular to the axis S of rotation of the rotor. The rotation of the rotor results in the generation of a closing force acting in the direction of the arrow 72 which moves the lower portion 52 of the windshield to the closed position.

In the preferred embodiment the closing force is generated by a pressure differential defined in the region between the portions of the windshield. As the buckets 52 move from the rest to the operating position air in the vicinity of the rotating buckets is pumped radially outwardly relative to the axis S of the rotor to thereby define a lower pressure region substantially between the upper and lower windshield portions. The lower portion 62 of the windshield responds to the pressure force generated by the pressure differential formed between the exterior of the lower portion and the interior thereof by the centrifuged pumping action of the rotor arms and the buckets 52 to displace the lower portion 62 along the skirt 14 in the direction of the arrow 72 (parallel to the axis S) from the open position to the closed position. The inside surface of the band 71 on the upper windshield portion 54 overlaps the outer surface of the lower windshield 62. Because of the relative stiffnesses the periphery of the lower windshield portion 62 grows by action of centrifugal force at a greater rate than does the band 71, thereby clamping the windshield portions to preclude vibration of the lower windshield portion 62. In addition, in the closed position the mating surfaces 60 and 70, respectively, on the upper and lower windshield portions 54 and 62 are joined to thereby minimize air leaks and windage losses occasioned by the pumping action of the arms 48 yet at the same time minimize windage losses occasioned by the configuration of the windshield. The lower windshield portion 62 is sized and weighted to insure that the closing motion does not occur prior to the time that the buckets 52 assume their operating orientation.

As the rotor slows the pressures inside and outside the windshield tend to equalize, thus permitting the lower portion 62 of the windshield to drop by its own weight to the open position. Preferably the lower portion 62 of the windshield will drop to the open position at a rotational speed which is greater than the speed at which the buckets 52 drop toward the rest position. As an alternative when the buckets 52 begin to drop from the operative position and abut against the interior surface of the lower portion 62 of the windshield the lower portion of the windshield is caused to move downwardly along the shaft to the open position.

With reference to FIGS. 6 through 10, shown are alternate embodiments of the invention. In these Figures, that part of the Figure shown to the right of the axis S of the rotor depicts the lower windshield portion 62 in the lower position while the part of the Figure to the left of the axis S shows the lower windshield portion 62 in the closed position.

Figure 6:
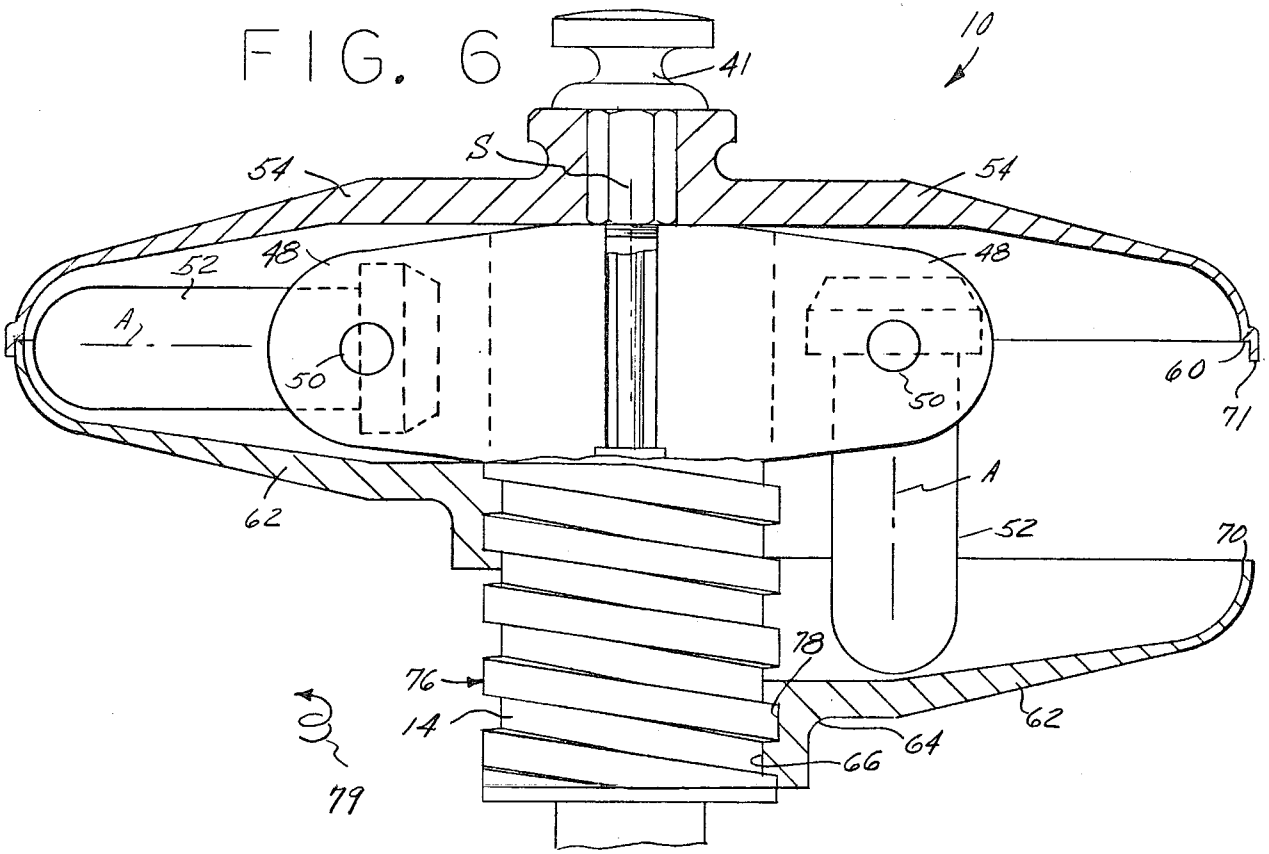
FIGS. 6 through 10 are side elevation views entirely in section of alternate embodiments of the invention in which that portion of each Figure to the right of the axis of rotation depicts the lower windshield in the open position while the portion of each Figure to the left of the axis of the rotation shows the lower windshield portion in the closed position.

In FIG. 6 the exterior surface of the shaft 14 is provided with a jack screw thread, as at 76. The opening 66 in the central region 64 of the lower portion 62 is correspondingly threaded as at 78 to form a nut fitting to the jack screw. When rotation starts both inertia forces and windage torque cooperate together to produce the closing force acting in a direction 79 (shown in FIG. 6 as a "right hand" screw direction) to move the lower windshield portion 62 to the closed position. When the centrifuge run is terminated and the rotor braked inertia forces act in a direction tending to unscrew the upper and lower portions while windage torque acts in an opposite direction. Since the windage torque diminishes rapidly with decreasing speed a speed will be reached where the inertia forces overcome the windage torque to cause the lower portion 62 of the windshield to move to the rest position. The embodiment shown in FIG. 6 is believed especially advantageous in reduced atmospheres, e.g., partial vacuum.

Figure 7:
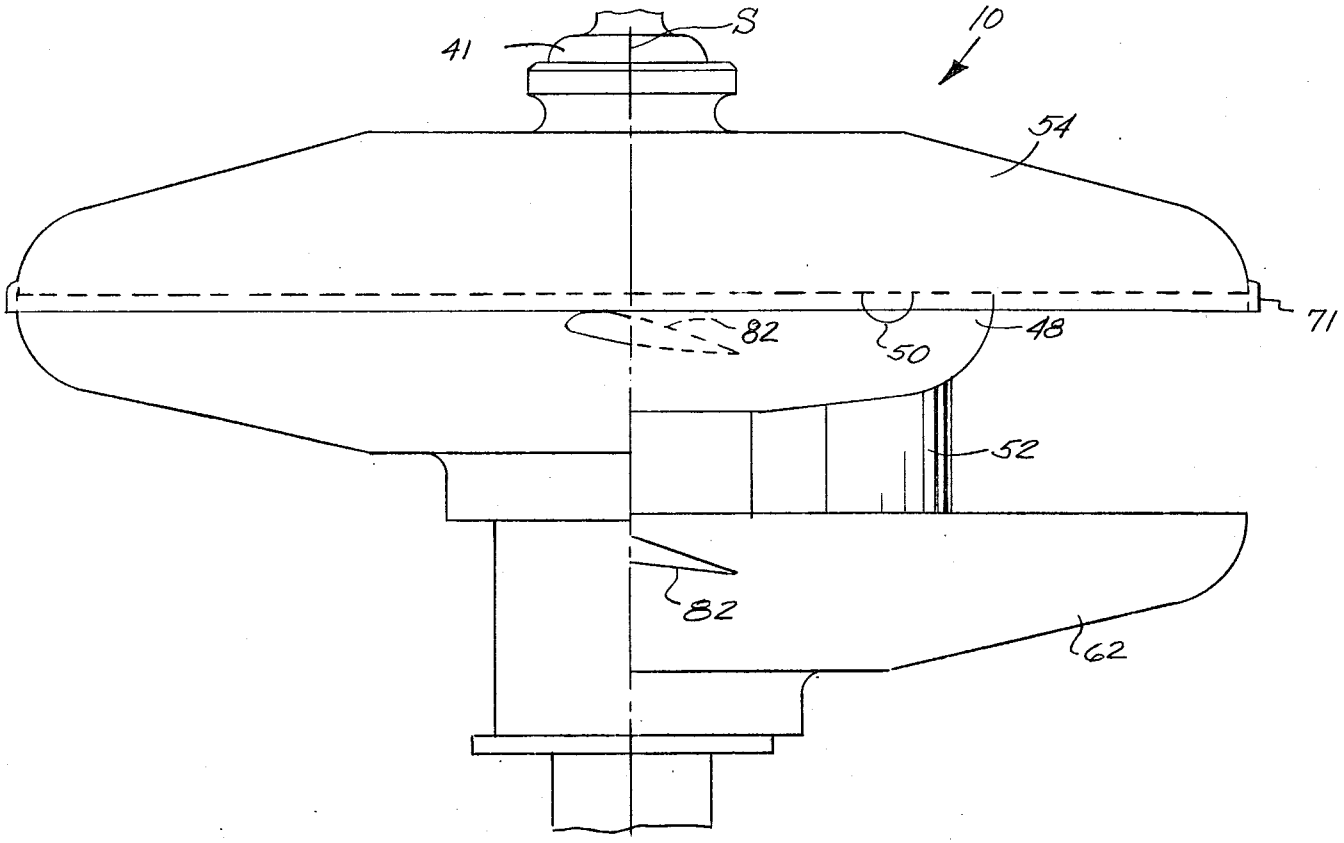

With reference to FIG. 7 the lower windshield portion 62 is provided with a plurality of airfoils 82 along the periphery thereof. The exact number, length, aspect ratio and angle of attack we selected so as to produce the least drag at the maximum rotor speed while still producing the closing force in the form of sufficient lift to move the lower portion 62 of the windshield to the closed position.

Figure 8:
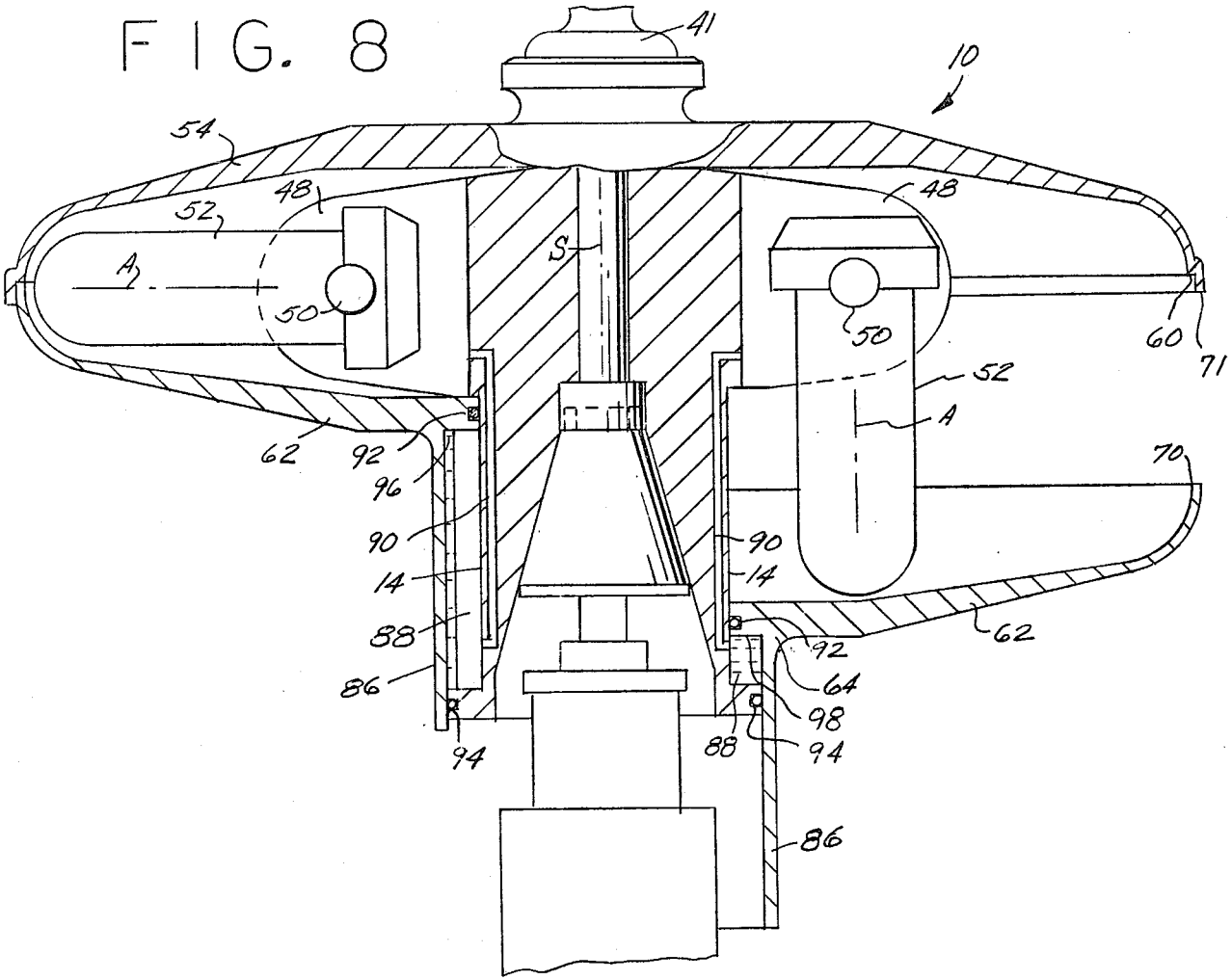

FIG. 8 discloses an alternate embodiment of the invention which a fluid piston is used to generate the closing force to close the lower portion 62 of the windshield. A cylindrical skirt 86 is attached to the central region 64 of the lower portion 62 of the windshield. The skirt 14 on the hub 12 is spaced from the interior surface of the region 64 on the lower portion 62 of the windshield and is cooperable with the same and with the skirt 86 to define an annular cylinder 88 therebetween. The annular cylinder 88 communicates with a vent volume 90 (shown in the form of a passage) defined within the rotor hub 12. The cylinder 88 is sealed by O-rings 92 and 94. A fixed volume of hydraulic fluid is disposed within the annular cylinder 88 (and perhaps into the volume 90). When the rotor is rotated the centrifugal force field urges the fluid in the annular cylinder 88 against the shoulder 98 defined on the underside of the central region 64. If hydraulic fluid is received within the volume 90 it is urged therefrom into the cylinder 88 by centrifugal force. The resulting closing force due to the fluid pressure acting against the shoulder 98 displaces the lower portion 62 of the windshield to the closed position. Centrifugal force effects maintain the hydraulic fluid in the annular band shown in the left side of FIG. 8. As the rotor slows the hydraulic fluid collects in the cylinder (and in the vent volume, if appropriate). As the fluid collects air is vented from the cylinder 88 through the vent 90.

It should be understood that various of the alternatives here discussed may be combined or used with other viable alternatives to construct a rotor in accordance with the present invention. For example, the embodiment discussed in FIG. 8 may be combined with the use of airfoils 82 (FIG. 7) to produce a useful rotor apparatus. Such an apparatus is believed advantageous inasmuch as the presence of the hydraulic fluid in the cylinder 88 (and in the volume 90) serves to damp the lower portion 62 and thus complements the closing lift force produced by the airfoil 82. The presence of the hydraulic fluid produces as damping force that is greatest while the lower portion 62 is in the open position and which decreases as that portion rises. This is opposite to the aerodynamic force produced by the airfoil and the combination of these embodiments is believed to produce a rotor which results in a smooth closing action of lower portion 62 of the windshield.

Figure 9:
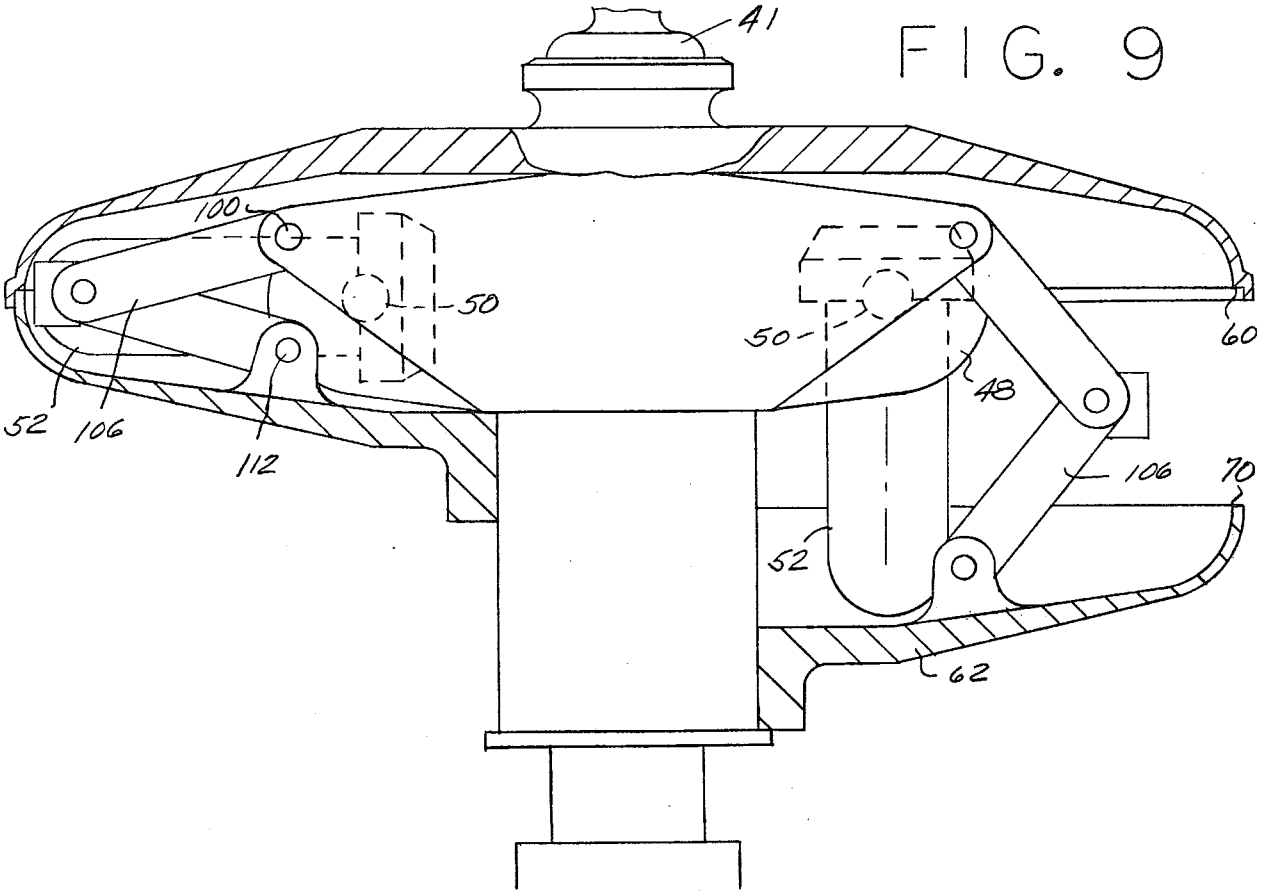

A further embodiment of the invention is shown in FIG. 9. In this embodiment linkages 106 with midweights 108 are mounted intermediate bucket positions. The linkages 106 are mounted between pivot pins 110 and 112 respectively disposed on the rotor and the lower portion 62 of the windshield. Centrifugal force acts on the weights 108 to urge them radially outwardly. A resulting closing force acts to lift the lower portion 62 to the closed position. Although the Figure discloses the linkages 106 as extending between the rotor hub 12 and the lower portion 62 of the windshield, any other suitable interconnection may be used. Since this embodiment does not depend upon aerodynamic or pressure differential effects, it is believed best suited in reduced atmosphere environments.

Figure 10:
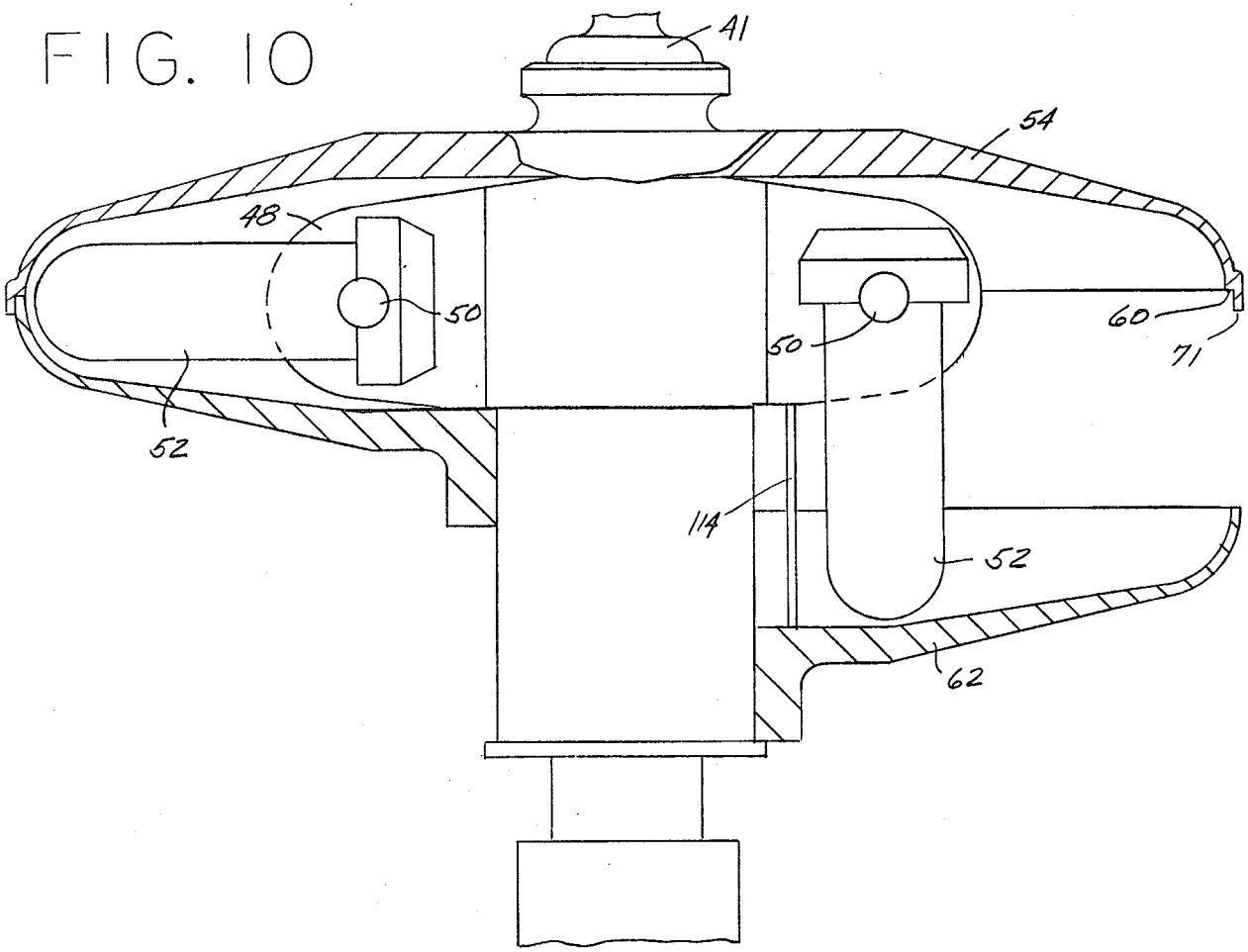

FIG. 10 shows an embodiment of the invention basically similar to that shown in FIGS. 1 through 5. Guidewires 14 are securely attached in any convenient manner between the rotor 10 and lower portions, 62. As the rotor rotates, the guidewires spiral generally tangentially to the direction of angular rotation, thus shortening the guidewires 114 to thereby assist the movement of the lower portion 62 of the windshield to the closed position.

In view of the foregoing it may be appreciated that a centrifuge rotor of the swinging bucket type has been disclosed which permits the maximum relative centrifugal force able to be generated by a rotor at a given rotor volume. Of course, those skilled in the art, having the benefit of the teachings hereinabove set forth may effect numerous modifications hereto. These modifications are to be construed as lying within the scope of the present invention as defined in the appended claims.

What is claimed is:

1. A rotor for a swinging bucket centrifuge comprising:

a shaft;

a plurality of rotor buckets pivotally mounted to the shaft, the buckets being pivotable from a rest position to an operating position;

an upper windshield portion attached to the shaft for rotation therewith, the outer boundary of the upper windshield portion terminating in a mating edge; and a lower windshield portion movably mounted with respect to the shaft, the lower windshield portion having a mating edge thereon, the lower windshield portion being movable in a direction parallel to the axis of rotation of the rotor in response to a closing force generated by the rotation of the rotor to displace the lower windshield portion along the shaft and dispose the mating edges thereof into closed engagement with the mating edges on the upper windshield portion.

2. The rotor of claim 1 wherein the closing force is due to a pressure differential generated by the centrifugal pumping action of the rotor and the buckets.

3. The rotor of claims 1 or 2 wherein the upper windshield portion is nonrotatably mounted with respect to the shaft.

4. The rotor of claim 3 wherein the lower windshield portion is nonrotatably mounted with respect to the shaft.

5. The rotor of claim 4 wherein the shaft exhibits a predetermined cross section and the lower windshield portion is provided with an opening of a corresponding cross section whereby the lower windshield portion is nonrotatably mounted with respect to the shaft.

6. The rotor of claim 5 wherein the rotor shaft and the opening in the lower windshield portion each exhibit a hexagonal cross section.

7. The rotor of claims 1 or 2 wherein the lower windshield portion is nonrotatably mounted with respect to the shaft.

8. The rotor of claim 7 wherein the shaft exhibits a predetermined cross section and the lower windshield portion is provided with an opening of a corresponding cross section whereby the lower windshield portion is nonrotatably mountable to the shaft.

9. The rotor of claim 8 wherein the rotor shaft and the opening in the lower windshield portion each exhibit a hexagonal cross section.

10. The rotor of claim 1 wherein the shaft has a screw thread thereon and the lower portion of the windshield has a corresponding screw thread thereon, the closing force being due to a pressure differential generated by the centrifugal pumping action of the rotor and buckets to rotatably displace the lower portion of the windshield along the screw threads on the shaft to the closed position.

11. The rotor of claim 1 wherein the exterior surface of the lower portion of the windshield has an airfoil thereon, the closing force being due to a pressure differential generated by the centrifugal pumping action of the rotor and the buckets to displace the lower portion of the windshield to the closed position, the movement of the lower portion of the windshield generating a lift force due to the airfoil which assists in the closure of the windshield.

12. The rotor of claim 1 wherein the shaft and the lower portion of the windshield cooperate to define a cylinder therebetween adapted to receive a hydraulic fluid therein, the rotation of the rotor generating a centrifugal force on a hydraulic fluid to urge the same against the lower portion of the windshield to generate the closing force by hydraulic pressure and to displace the lower portion of the windshield to the closed position.

13. The rotor of claim 1 wherein a flexible linkage is disposed between the rotor body and the lower portion of the windshield, the linkage having a weight thereon, centrifugal force due to the rotation of the rotor urging the weight radially outwardly to generate the closing force to flex the linkage and displace the lower portion to the closed position.

14. The rotor of claim 1 further comprising a plurality of guidewires displaced between the upper and lower portions of the windshield, the closing force being due to a pressure differential generated by the centrifugal pumping action of the rotor and brackets to displace the lower portion to the closed position, rotation of the rotor also serving to spiral the guidewires to shorten the distance between the upper and lower portions of the windshield to assist in displacement of the lower portion of the windshield to the closed position.

* * * * *

United States Patent [19]

Laszczower

[11] 4,435,170

[45] Mar. 6, 1984

[54] ASSEMBLY FOR RECEIVING AND DISCHARGING A COLLECTION OF BLOOD

[75] Inventor: Max Laszczower, Basel, Switzerland

[73] Assignee: Solco Basel AG, Switzerland

[21] Appl. No.: 273,711

[22] Filed: Jun. 15, 1981

[51] Int. Cl.[3] ..... A61M 37/00; A61B 19/00

[52] U.S. Cl. ..... 604/4; 604/5; 604/403

[58] Field of Search ..... 137/205; 141/8, 18; 128/276, 278, 214 R, 297; 251/6; 604/4, 5, 9, 27, 28, 30, 33, 34, 35, 403, 44

[56] References Cited

U.S. PATENT DOCUMENTS

| | | | |
|---|---|---|---|
| 2,309,302 | 1/1943 | Butler et al. | 251/6 |
| 3,191,600 | 6/1965 | Everett | 128/214 R |
| 3,896,733 | 7/1975 | Rosenberg | 128/214 R |
| 3,951,145 | 4/1976 | Smith | 128/272 |
| 4,047,526 | 9/1977 | Reynolds et al. | 604/4 |
| 4,065,093 | 12/1977 | Phillips | 251/6 |

*Primary Examiner*—C. Fred Rosenbaum
*Assistant Examiner*—J. L. Kruter
*Attorney, Agent, or Firm*—Neil F. Markva

[57] ABSTRACT

The assembly comprises a blood collection vessel, a flexible tube removably connected to the collection vessel and a flow control mechanism for regulating the flow of liquid into or out of the collection vessel. One of the shaped sections of the collection vessel has a size effective to be grasped by the hand of an operator. Inlet and outlet means are disposed at opposite ends of the vessel so that blood may be introduced into the vessel at one end and discharged at the other end when desiring to place the blood back into the person. Other specific features of the invention include the particular structural configuration of the flow control mechanism the disposition of a flexible tube between the flow control mechanism and the collection vessel and other features of the collection vessel.

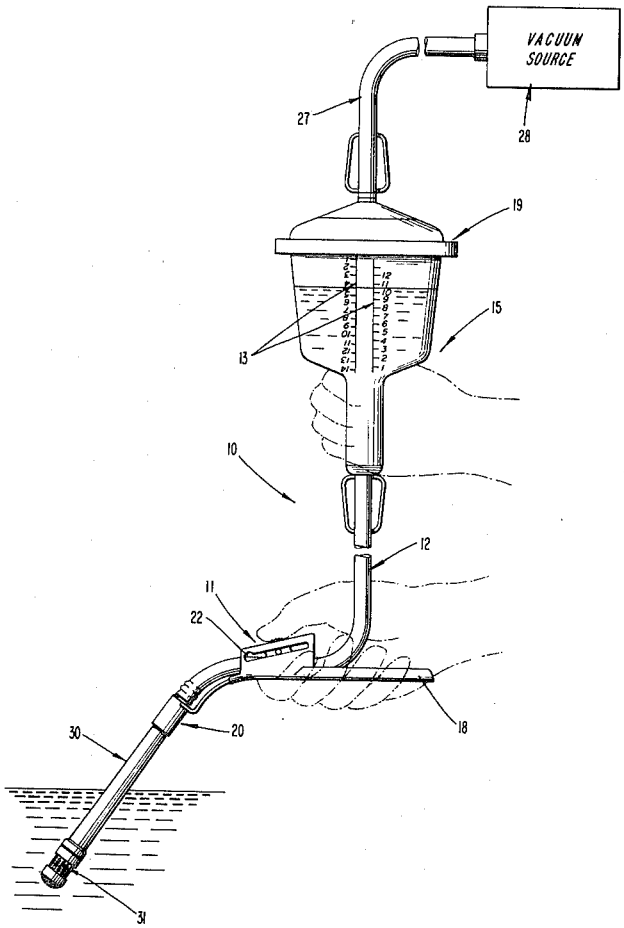

20 Claims, 7 Drawing Figures